US009926689B2

(12) United States Patent
Arbelaez

(10) Patent No.: US 9,926,689 B2
(45) Date of Patent: Mar. 27, 2018

(54) PLUMBING FITTING

(71) Applicant: Alberto Arbelaez, Kensignton (AU)

(72) Inventor: Alberto Arbelaez, Kensignton (AU)

(73) Assignee: ALberto Arbelaez, Kensington (AU)

( * ) Notice: Subject to any disclaimer, the term of this patent is extended or adjusted under 35 U.S.C. 154(b) by 0 days.

(21) Appl. No.: 14/780,390

(22) PCT Filed: Mar. 18, 2014

(86) PCT No.: PCT/AU2014/000341
§ 371 (c)(1),
(2) Date: Sep. 25, 2015

(87) PCT Pub. No.: WO2014/153619
PCT Pub. Date: Oct. 2, 2014

(65) Prior Publication Data
US 2016/0083941 A1 Mar. 24, 2016

(30) Foreign Application Priority Data
Mar. 27, 2013 (AU) ..... 2013901054

(51) Int. Cl.
*E03C 1/04* (2006.01)
*E03C 1/02* (2006.01)

(52) U.S. Cl.
CPC ..... *E03C 1/04* (2013.01); *E03C 1/021* (2013.01); *E03C 1/0404* (2013.01); *E03C 2001/026* (2013.01)

(58) Field of Classification Search
CPC ..... E03C 1/04; E03C 1/0404
USPC ..... 4/675–678
See application file for complete search history.

(56) References Cited

U.S. PATENT DOCUMENTS 1,551,227 A 8/1925 Vallier
1,572,412 A * 2/1926 Vallier ..... E03C 1/042 137/625.47
2003/0146307 A1 8/2003 Herring
2006/0086394 A1 4/2006 Molina et al.
2007/0225548 A1 9/2007 Stelly
2010/0043898 A1 2/2010 Eckhaus
2010/0096026 A1 4/2010 Chen
(Continued)

FOREIGN PATENT DOCUMENTS

EP 1008695 A1 6/2000

OTHER PUBLICATIONS http://www.ebaumsworld.com/images/penis-faucet/82161785/ KellyT, penis faucet, upladed Jan. 3, 2012 (picture).*
(Continued)

*Primary Examiner* — Huyen Le
(74) *Attorney, Agent, or Firm* — Martensen IP

(57) ABSTRACT

A plumbing fitting for dispensing of hot and cold water or a mixture thereof; said fitting including an elongate spout or spigot and a mounting portion for locating said plumbing fitting at a surface; said elongate spout provided with a dispensing orifice arranged at an underside of said elongate spout and proximate a tip portion of said spout; a passage through said spout communicating with said orifice and an inlet at said mounting portion; said plumbing fitting characterized in further including a pair of partially conjoined, generally globular structures at a base portion of said elongate spout.

10 Claims, 6 Drawing Sheets

(56) References Cited

U.S. PATENT DOCUMENTS

2013/0019977 A1 1/2013 Hung

OTHER PUBLICATIONS

International Search Report and Written Opinion of the International Searching Authority; dated May 6, 2014; PCT/AU2014/000341.

* cited by examiner

PLUMBING FITTING

RELATED APPLICATION

The present application relates to and claims the benefit of priority to PCT Application no. PCT/AU2014/000341 filed 18 Mar. 2014, which is hereby incorporated by reference in its entirety for all purposes as if fully set forth herein.

TECHNICAL FIELD

The present invention relates to fittings for the dispensing of water and, more particularly to water outlets.

BACKGROUND

Water outlets for the dispensing of water at wash basins, kitchen sinks, bath tubs and in showers for example, are known in many forms and designs. Typically these designs are largely utilitarian, largely devoid of decoration or interest.

Another disadvantage of known dispensers or spigots is that generally hot and cold water are introduced into the tube of the dispenser from control valve in close proximity to the spigot passage allowing little of no thorough mixing of the hot and cold water streams.

Plumbing fittings are almost entirely utilitarian and uninteresting in their configurations. Outlet spouts for the most part are formed as cylindrical or ovoid tubing of generally constant cross section.

It is an object of the present invention to address or at least ameliorate some of the above disadvantages or provide a useful alternative.

Notes

The term "comprising" (and grammatical variations thereof) is used in this specification in the inclusive sense of "having" or "including", and not in the exclusive sense of "consisting only of".

Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out in the appended claims The above discussion of the prior art in the Background of the invention, is not an admission that any information discussed therein is citable prior art or part of the common general knowledge of persons skilled in the art in any country.

SUMMARY OF INVENTION

Accordingly, in one broad form of the invention, there is provided a plumbing fitting for dispensing of hot and cold water or a mixture thereof; said fitting including an elongate spout or spigot and a mounting portion for locating said plumbing fitting at a surface; said elongate spout provided with a dispensing orifice arranged at an underside of said elongate spout and proximate a tip portion of said spout; a passage through said spout communicating with said orifice and an inlet at said mounting portion; said plumbing fitting characterized in further including a pair of partially conjoined, generally globular structures at a base portion of said elongate spout.

Preferably, said pair of partially conjoined, generally globular structures are hollow.

Preferably, said mounting portion includes an annular flange and an internally threaded cylindrical body projecting rearwardly from said flange; said body adapted for screwed connection to a threaded spigot of a water reticulation outlet.

Preferably, said mounting portion includes an annular flange and an externally threaded, cylindrical body projecting rearwardly from said flange; said body provided with at least an internally threaded ring for securing said plumbing fitting to a supporting surface.

Preferably, said body is provided with a pair of treaded sockets; said threaded sockets providing for connection of respective hot and cold water supply lines.

Preferably, said generally globular structures communicate with a water inlet or inlets of said fitting and with said elongate spout so as to provide a turbulent water mixing chamber.

Preferably, said fitting further includes a control portion; said control portion including a housing for insertion of a valve cartridge for selectively controlling said hot and cold water.

Preferably, said control portion includes a handle projecting from said control portion; said handle operatively connected to said valve cartridge.

Preferably, at least a portion of said pair of partially conjoined, generally globular structures provides a housing for said valve cartridge.

Preferably, said fitting comprises a shower stall wall outlet.

Preferably, said fitting comprises a bath spout.

Preferably, said elongate spout and said partially bifurcated, generally globular structures are shaped so as to represent human male genitalia.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF DRAWINGS

Embodiments of the present invention will now be described with reference to the accompanying drawings wherein.

Figure 1:
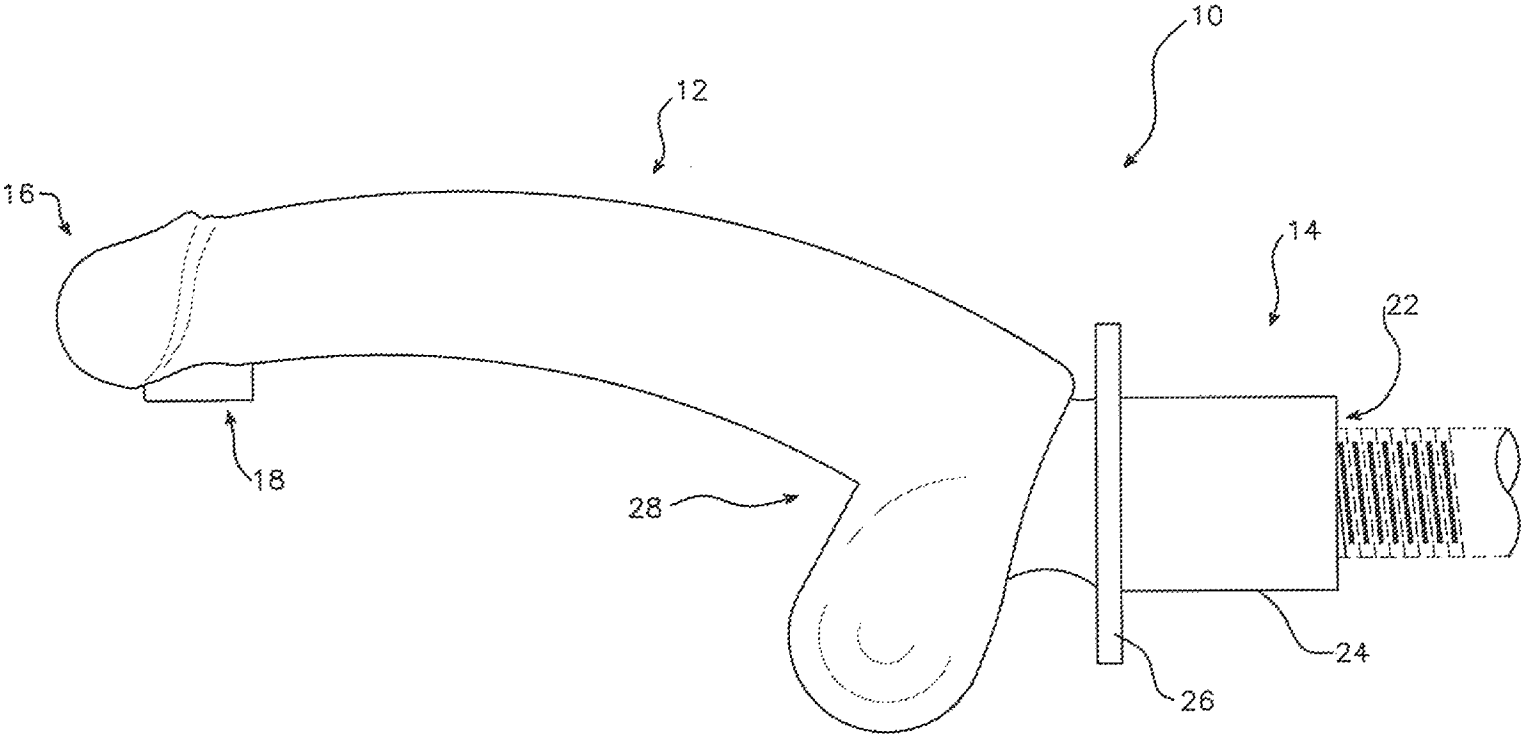
FIG. 1 is a side view of a first preferred embodiment of the invention.
Figure 2:
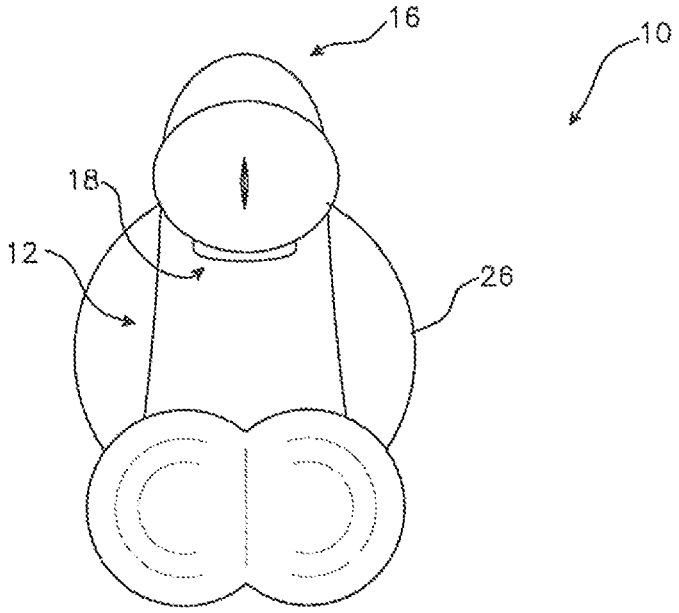
FIGS. 2 and 3 are front and rear views respectively of the first preferred embodiment of FIG. 1.
Figure 3:
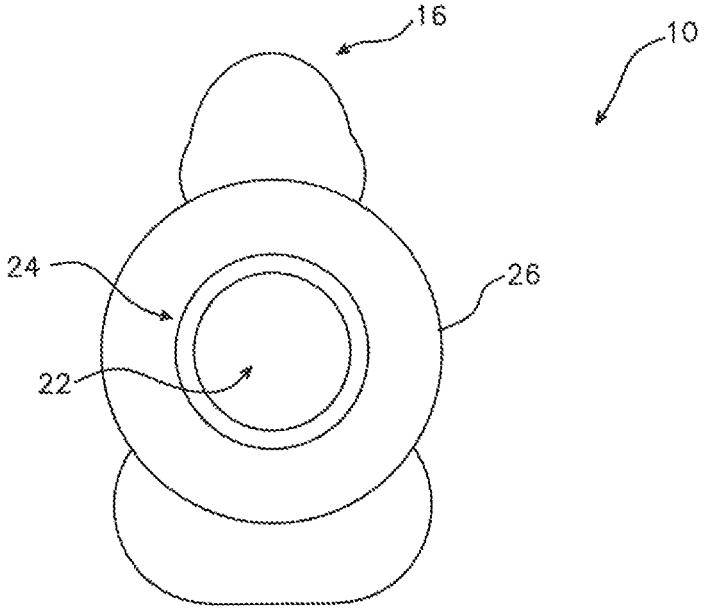
Figure 4:
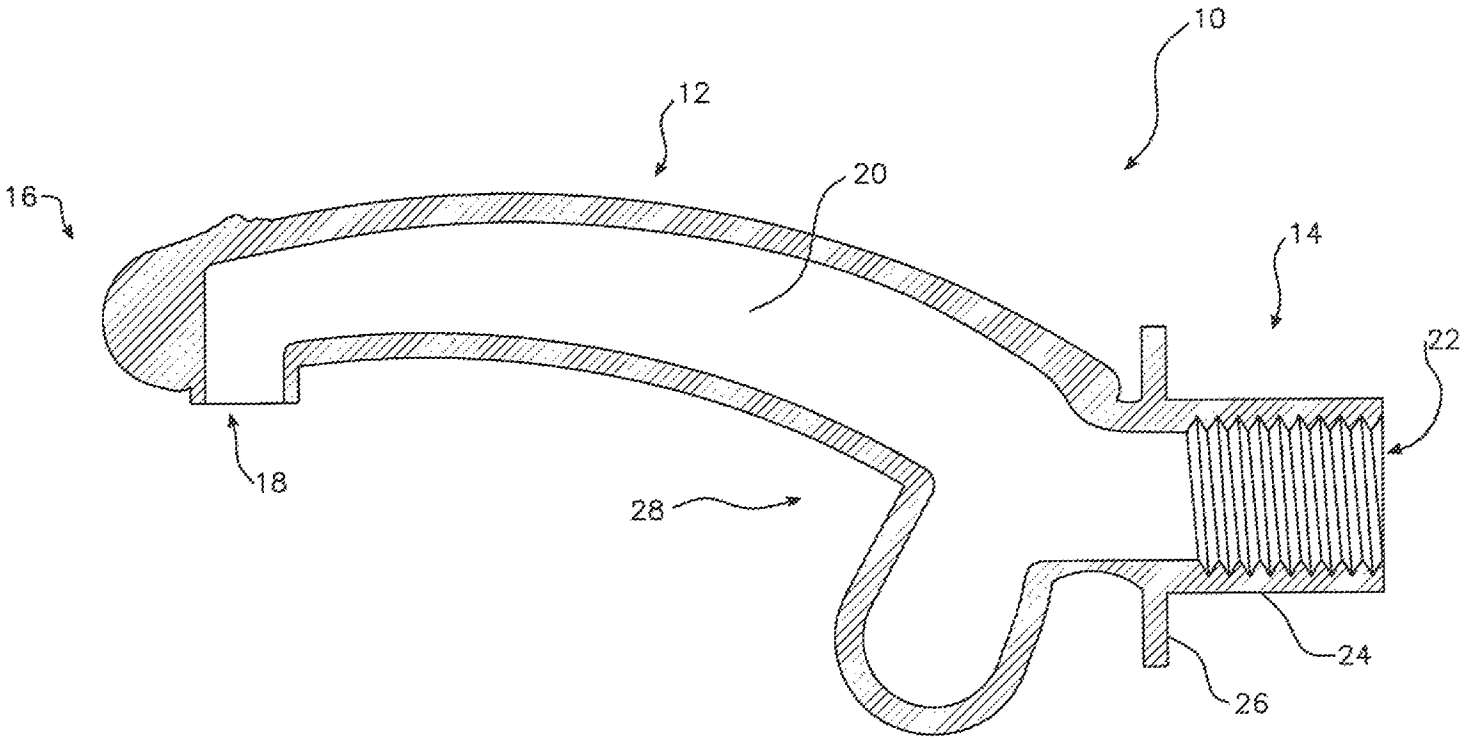
FIG. 4 is a sectioned view of the first preferred embodiment of FIGS. 1 to 3.

The Figures depict embodiments of the present invention for purposes of illustration only. One skilled in the art will readily recognize from the following discussion that alternative embodiments of the structures and methods illustrated herein may be employed without departing from the principles of the invention described herein.

DESCRIPTION OF EMBODIMENTS

Embodiments of the present invention are hereafter described in detail with reference to the accompanying Figures. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

First Preferred Embodiment

The present invention provides for a plumbing fitting for the dispensing of hot and cold water or a mixture of hot and cold water. In this preferred embodiment of the most basic form of the fitting 10 with reference to FIGS. 1 to 4, it comprises a curved elongate spout or spigot 12 extending from a mounting portion 14.

The spout 12 is provided at its underside and proximate the tip 16 with an orifice 18 communicating with a passage 20 (shown in FIG. 4) which in turn communicates with an inlet 22 provided in the mounting portion 14.

Provided at the underside and proximate the base 24 of the spout 12, are a pair of partially conjoined, generally globular structures 26; that is, the structures are in the form of two generally spherical surfaces, partially merged one into the other. These structures 26 are preferably hollow, and are then likewise in communication with the passage 20 and inlet 22.

Mounting portion 14 comprises a cylindrical body 24 extending rearwardly from an annular mounting flange 26, adapted for flush fitting of the plumbing fitting against a wall surface.

Inlet 22 is provided with an internal thread for screwed connection to a water reticulation outlet such as the outlet spigot from a hot and cold water tap assembly.

The preferred embodiment of FIGS. 1 to 4 may be adapted to both a wall outlet above a bath, wash basin or shower stall.

The terminology used herein is for the purpose of describing particular embodiments only and is not intended to be limiting of the invention. As used herein, the singular forms "a," "an" and "the" are intended to include the plural forms as well, unless the context clearly indicates otherwise. Thus, for example, reference to "a component surface" includes reference to one or more of such surfaces.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be also understood that when an element is referred to as being "on," "attached" to, "connected" to, "coupled" with, "contacting", "mounted" etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

Second Preferred Embodiment

Figure 5:
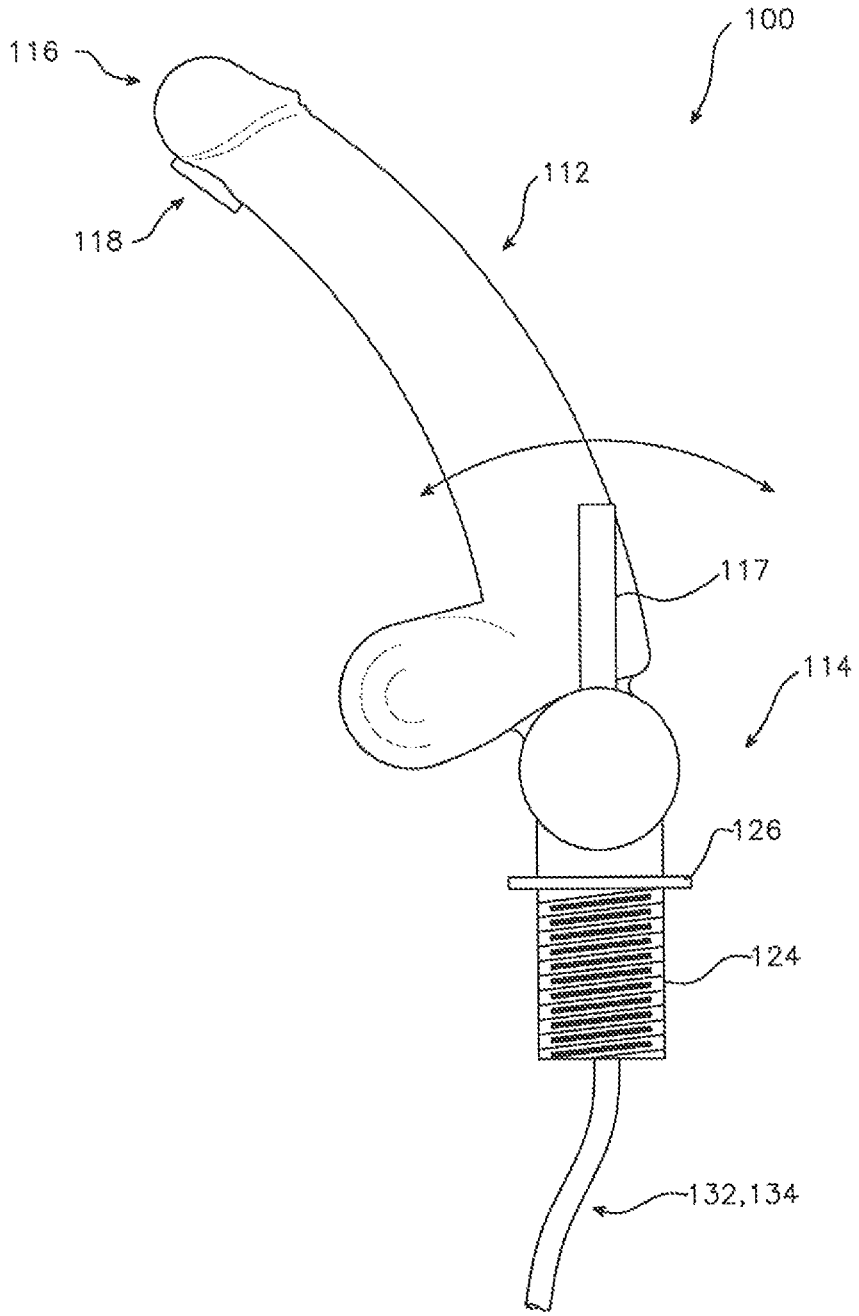
FIG. 5 is a side view of a further preferred embodiment of the invention.
Figure 6:
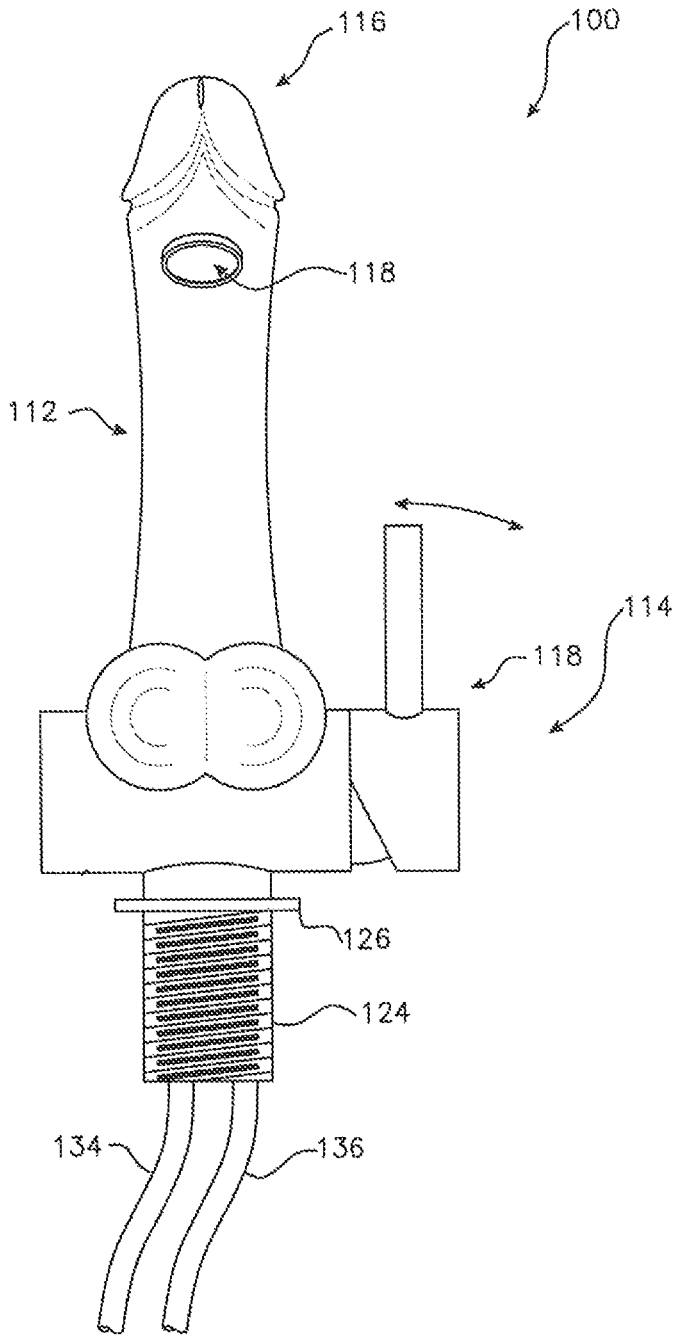
FIG. 6 is a front view of the further preferred embodiment of FIG. 5.

With reference now to FIGS. 5 and 6, the plumbing fitting 100 according to the invention may include a mixer assembly 114. In a preferred, but not limiting arrangement, mixer assembly 114 may include a transversely mounted cylindrical housing 116 for housing a standard mixer cartridge (not shown).

As well known in the art, such cartridges provide for sliding plate valve elements which may be controlled to selectively open hot and cold water passages, by means in the present example, of handle element 117. Control of flow of hot or cold, or a mixture of hot and cold water, is provided by selectively rotating handle 117 with two degrees of freedom as shown by arrows in FIGS. 5 and 6; rotation about the long axis of cylindrical housing 116 controlling selection of hot and/or cold water, while rotation at an angle to that axis controls flow.

Plumbing fitting 100 is further provided with an inlet and mounting portion 124 extending downwardly from a mounting flange 126, which is provided at its underside with a pair of threaded sockets (not visible) for the connection of flexible hot and cold water lines 132 and 134. Mounting portion 124 may, in one preferred embodiment, be provided with an internally threaded ring (not shown) for securing the plumbing fitting 100 to a surface, or other securing means as commonly used in the art.

Third Preferred Embodiment

Figure 8:
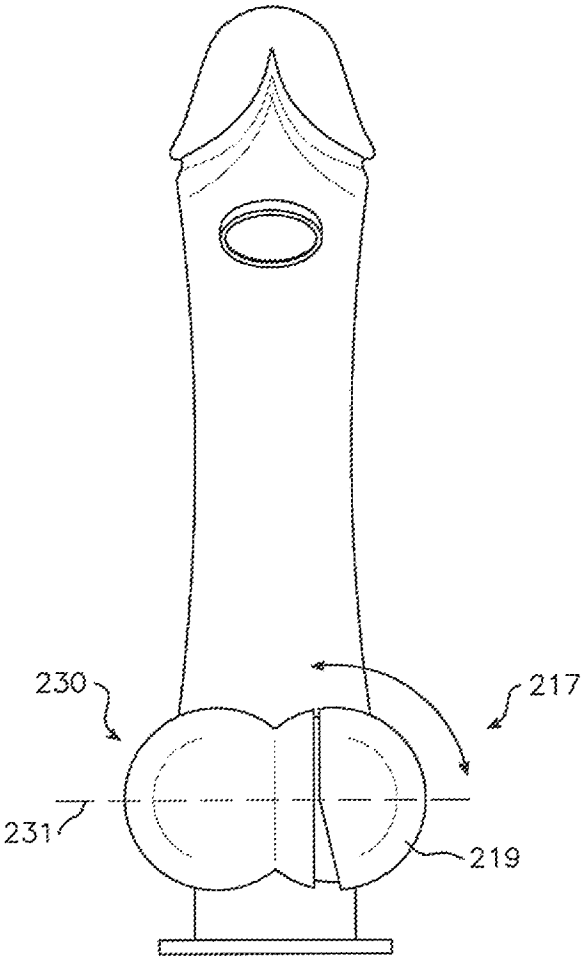
FIGS. 7 and 8 present a side and front view, respectively, of a further preferred embodiment of the present invention.
Figure 7:
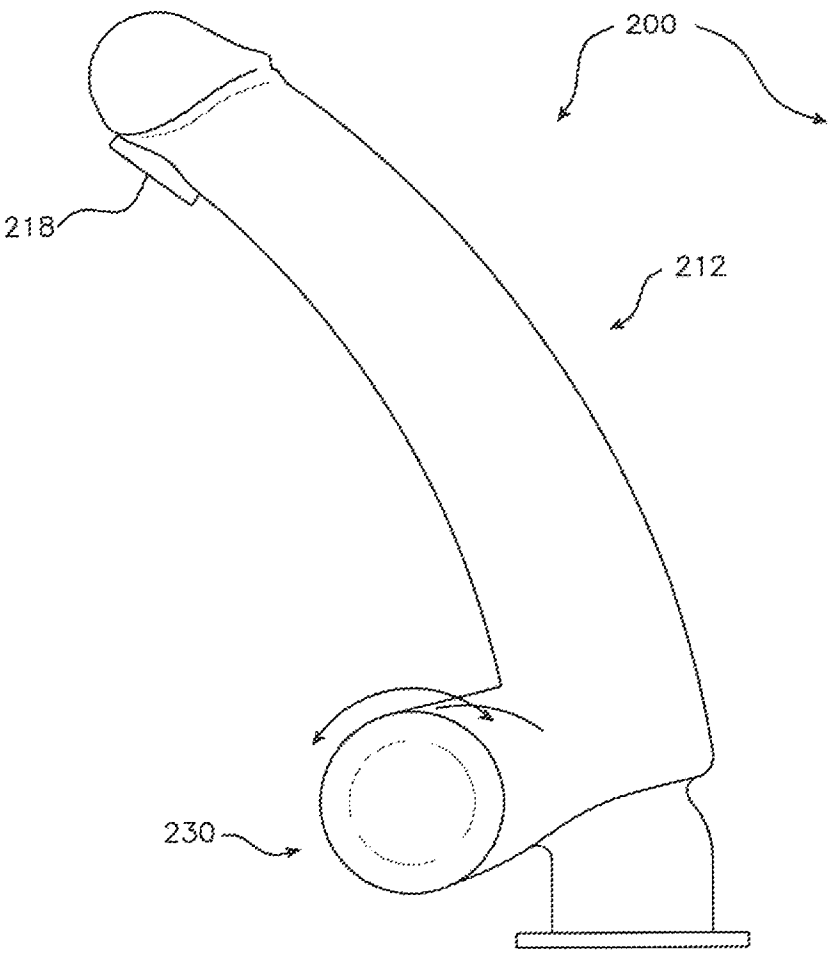

In a further preferred embodiment of the invention with reference to FIGS. 7 and 8, the plumbing fitting 200 again comprises an elongate spout 212 provided at a base portion of the spout with a pair of partially conjoined, generally globular structures 230. In this instance, at least a portion of the globular structures are arranged to house a control valve (not shown) as described above for the mixing and delivery of hot or cold water, or a mixture thereof, to a mixing area and to the passage through the spout, again as described for the embodiments above.

Thus, for example, the cartridge may be accommodated substantially in one of the globular structures, disposed generally along an axis 231 defined by the centres of the structures; a part of the other globular structure providing the mixing chamber through which water flows to the passage through the spout 212.

In a preferred arrangement, the control or handle element 217 may form a partial shell 219 conforming in general shape to the globular structure housing the valve element and articulated to rotate firstly about the long axis 231 of the control valve and secondly at an angle to that axis.

In each of the above embodiments, the shape of the spout (12,112) and pair of partially conjoined, generally globular structures (26,126) are shaped to represent the human male genitalia.

INDUSTRIAL APPLICABILITY

Apart from the distinctive shape of the spout and pair of partially conjoined, generally globular structures of the plumbing fitting of the invention, the cavity within the generally globular structures, and which preferably generally conforms in shape to that of the outside surface, provides in effect a mixing chamber for turbulent mixing of flows of hot and cold water flowing from the mixer cartridge or from the fitting's inlet.

The above describes only some embodiments of the present invention and modifications, obvious to those skilled in the art, can be made thereto without departing from the scope of the present invention.

While there have been described above the principles of the present invention in conjunction with a plumbing fitting, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom.

The invention claimed is:

1. A plumbing fitting for dispensing of hot and cold water or a mixture thereof; said fitting including an elongate spout or spigot and a mounting portion for locating said plumbing fitting at a surface; said elongate spout provided with a dispensing orifice arranged at an underside of said elongate spout and proximate a tip portion of said spout; a passage through said spout communicating with said orifice and an inlet at said mounting portion; said plumbing fitting characterized in further including a pair of partially conjoined, generally globular hollow structures at a base portion of said elongate spout; and wherein said generally globular hollow structures are in liquid communication with a water inlet or inlets of said fitting and with said elongate spout so as to provide a turbulent water mixing chamber within the generally globular hollow structures.

2. The plumbing fitting of claim 1 wherein said mounting portion includes an annular flange and an internally threaded cylindrical body projecting rearwardly from said flange; said body adapted for screwed connection to a threaded spigot of a water reticulation outlet.

3. The plumbing fitting of claim 1 wherein said mounting portion includes an annular flange and an externally threaded, cylindrical body projecting rearwardly from said flange; said body provided with at least an internally threaded ring for securing said plumbing fitting to a supporting surface.

4. The plumbing fitting of claim 3 wherein said body is provided with a pair of treaded sockets; said threaded sockets providing for connection of respective hot and cold water supply lines.

5. The plumbing fitting of claim 1 wherein said fitting further includes a control portion; said control portion including a housing for insertion of a valve cartridge for selectively controlling said hot and cold water.

6. The plumbing fitting of claim 5, wherein said control portion includes a handle projecting from said control portion; said handle operatively connected to said valve cartridge.

7. The plumbing fitting of claim 5, wherein at least a portion of said pair of partially conjoined, generally globular structures provide a housing for said valve cartridge.

8. The plumbing fitting of claim 1 wherein said fitting comprises a shower stall wall outlet.

9. The plumbing fitting of claim 1 wherein said fitting comprises a bath spout.

10. The plumbing fitting of claim 1 wherein said elongate spout and said partially bifurcated, generally globular structures are shaped so as to represent human male genitalia.

* * * * *